US011255098B1

(12) United States Patent
Bushey

(10) Patent No.: US 11,255,098 B1
(45) Date of Patent: Feb. 22, 2022

(54) SURFABLE WAVE GENERATOR AND DISPLACER

(71) Applicant: Swell Manufacturing LLC, Queen Creek, AZ (US)

(72) Inventor: John A. Bushey, Eden Prairie, MN (US)

(73) Assignee: Swell Manufacturing, LLC, Queen Creek, AZ (US)

( * ) Notice: Subject to any disclaimer, the term of this patent is extended or adjusted under 35 U.S.C. 154(b) by 0 days.

(21) Appl. No.: 16/875,950

(22) Filed: May 15, 2020

Related U.S. Application Data

(60) Provisional application No. 62/849,291, filed on May 17, 2019.

(51) Int. Cl.
*E04H 4/00* (2006.01)
*A63G 31/00* (2006.01)
*A63B 69/00* (2006.01)

(52) U.S. Cl.
CPC ..... *E04H 4/0006* (2013.01); *A63B 69/0093* (2013.01); *A63G 31/007* (2013.01)

(58) Field of Classification Search
CPC . E04H 4/0006; A63B 69/0093; A63G 31/007; B63B 34/70
See application file for complete search history.

(56) References Cited

U.S. PATENT DOCUMENTS 1,763,491 A * 6/1930 Voltz ..... E04H 4/0006 4/491
3,789,612 A * 2/1974 Richard ..... E04H 4/0006 405/79
4,507,018 A * 3/1985 Andersen ..... E02B 3/00 4/491
4,705,428 A * 11/1987 Andersen ..... E04H 4/0006 4/491
4,806,048 A * 2/1989 Ito ..... E04H 4/0006 405/79
4,976,570 A * 12/1990 Davis ..... F04D 35/00 4/491
9,920,544 B1 * 3/2018 Bennett ..... E04H 4/0006
10,119,284 B1 * 11/2018 Dunlap ..... E04H 4/0006
2005/0084333 A1 * 4/2005 Zadig ..... F04B 17/00 405/79
2011/0188938 A1 * 8/2011 Nedwed ..... B63B 35/08 405/79
2015/0037098 A1 * 2/2015 Carter ..... A01K 63/006 405/79
2019/0323249 A1 * 10/2019 Grantham ..... A63G 31/007

OTHER PUBLICATIONS

"Piston Coastal Wave Generators", Edinburgh Designs Ltd., Available Online at http://www4.edesign.co.uk/product/piston-wave-generators; accessed on May 15, 2020 (3 pages).

* cited by examiner

*Primary Examiner* — Carib A Oquendo
(74) *Attorney, Agent, or Firm* — Alliance IP, LLC

(57) ABSTRACT

An apparatus comprises a wave generator configured to move water on a front side of the wave generator to generate a surfable wave and a displacer configured to move in synchronization with the wave generator, the displacer to displace water on a back side of the wave generator to compensate for water elevation changes on the back side of the wave generator that would occur in the absence of the displacer.

19 Claims, 5 Drawing Sheets

SURFABLE WAVE GENERATOR AND DISPLACER

RELATED APPLICATION

This application claims benefit under 35 U.S.C. § 119(e) of U.S. Provisional Application Ser. No. 62/849,291, entitled "WAVE GENERATOR COMPENSATION DISPLACER" filed May 17, 2019.

BACKGROUND

Surfable wave generators may displace water within a basin using, e.g., mechanical, pneumatic, or hydrodynamic systems. Various wave generators may include plungers, flaps, or pistons that move relative to the water to cause displacement of the water, resulting in generation of waves in the water.

BRIEF DESCRIPTION OF THE DRAWINGS

Like reference numbers and designations in the various drawings indicate like elements.

DETAILED DESCRIPTION

Figure 1:
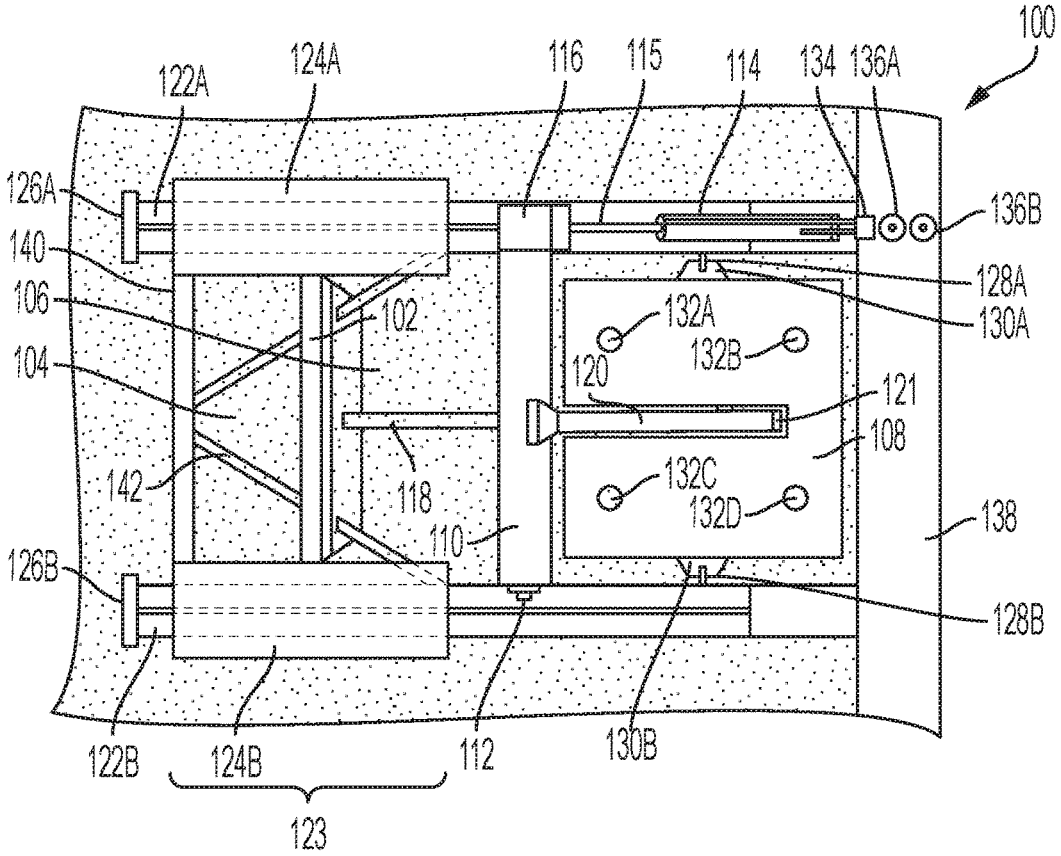
FIG. 1 illustrates a top view of a wave generation system 100 at the middle of a stroke cycle in accordance with certain embodiments.

Various surfable wave generation systems suffer from drawbacks during wave generation. For example, when a piston or flap generator is submerged so that both the front and back surfaces of the generator are exposed to the water, waves are generated in the desired direction (away from the front surface of the wave generator) and in an undesired direction (away from the back surface of the wave generator). Generation of the back waves are undesirable as such generation requires energy input (potentially doubling the power usage of the wave generator), back waves cause excessive splashing and disturb the wave generation system, and the water on the back surface of the wave generator adds to the effective moving mass of the drive system of the wave generation system. The backwards motion of a wave generator may also displace water causing an elevation in the water level on the back side of the wave generator, which can cause flooding and increased forces on the wave generator.

Some systems address back waves and flooding by evacuating the water from the back side of the wave generator and sealing the wave generation system such that no back waves are generated and no flooding occurs. However, seals and sealing surfaces, along with the need to counterbalance the hydrostatic force of the water on the front side of the wave generator, increase the cost and complexity of the systems.

Various embodiments of the present disclosure provide a wave generation system comprising a wave generator and a displacer. The movements of the displacer and the wave generator may be synchronized, and the displacer may displace water behind the wave generator as the wave generator moves forward such that the elevation of the water level behind the wave generator is held essentially constant. For example, in one embodiment, the elevation of the water level may differ by less than 10% over the course of a stroke cycle. As another example, in one embodiment, the elevation of the water level may differ by less than 5% over the course of a stroke cycle. In yet another example, in one embodiment, the elevation of the water level may differ by less than 1% over the course of a stroke cycle. Because the elevation of the back water does not substantially change during wave generation, the back waves that would normally result from the motion of the wave generator are essentially canceled by the motion of the compensating displacer. In some embodiments, the displacer is mechanically coupled to the wave generator such that the wave generator and the displacer move together. In some embodiments, the mass of the displacer is adjustable (e.g., using one or more of a ballast tank, trim tank and/or other methods) to tune a buoyancy force and gravity force that counteract inertia against the movement of the wave generator. These forces may be used to aid the drive system of wave generation system (and may cancel out a substantial portion of the inertia force needed to start movement of the wave generator). In some embodiments, the mass of the displacer may be adjusted based on characteristics of the drive system. For example, the mass may be biased to reduce the force required of the drive system at the beginning of the stroke cycle while increasing the force required at the end of the stroke cycle (e.g., when the drive system includes a hydraulic system that may benefit from reduced force requirements at one or more portions of the stroke cycle).

One or more of the embodiments described herein may provide one or more technical advantages. Such technical advantages may include, for example, substantially eliminating the back wave of a surfable wave (or other wave) generation system, maintenance of a constant back water elevation during wave generation resulting in substantially equal back and front forces on the wave generator, reduction of the size of the space behind the wave generator, reduction of component size, or reduction of power requirements of the drive system.

Figure 2:
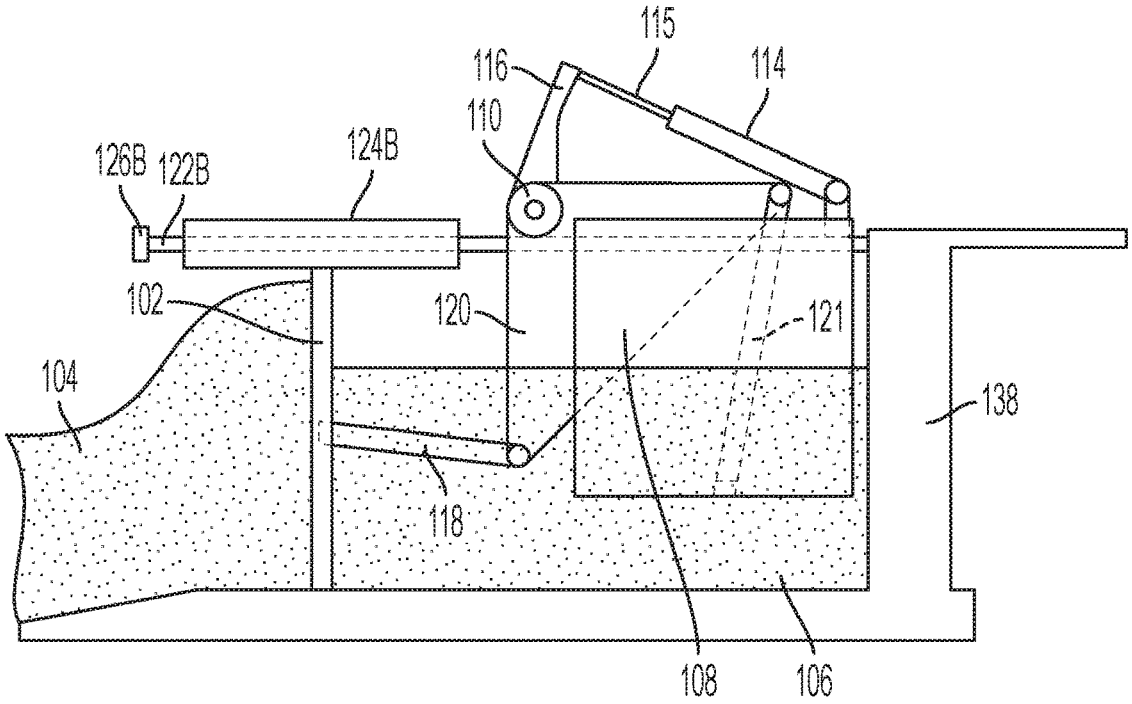
FIG. 2 illustrates a side view of a wave generation system 100 at the middle of a stroke cycle in accordance with certain embodiments.

FIG. 1 illustrates a top view and FIG. 2 illustrates a side view of a wave generation system 100 at the middle of a stroke cycle in accordance with certain embodiments. Wave generation system 100 includes a wave generator 102 mechanically coupled to a displacer 108. Wave generator 102 is coupled to the displacer 108 via wave generator link 118, torque tube 110, drive arm 120, and displacer link 121. System 100 further includes a hydraulic actuator 114 that operates a piston 115 to control movement of the torque tube 110 via a torque arm 116. Actuator 114 is controlled via control valve 134 which selectively couples hydraulic fluid stored in accumulators (e.g., 136A, 136B) and/or a pump (not shown) to the actuator to control movement of the piston 115.

The wave generator 102 may be coupled to a wave generator frame 123 which may include, e.g., wave generator guide rail interfaces 124A and 124B which interface with wave generator guide rails 122A and 122B to constrain the movement of the wave generator 102 within a desired pattern. In some embodiments, wave generator guide rails 122A and 122B may be disposed on top of respective support walls, which are part of encasement 138. In the embodiment depicted, wave generator frame 123 also includes a lateral structural channel 140 which provides support for the frame 123 and helps maintain a consistent distance between the guide rail interfaces 124A and 124B. In various embodiments, the frame 123 may include more than one lateral structural channel 140 at any suitable location(s) along the frame (e.g., one channel 140 may be placed proximate one end of the frame and another channel 140 may be placed proximate the other end of the frame). In some embodiments, a lateral structural channel 140 is placed directly over and is coupled to or integrated with wave generator 102. Over travel stops 126A and 126B may enforce a limit on forward movement (movement to the left in the depicted embodiment) of the wave generator frame 123. Additionally or alternatively other travel stops may be used to enforce a limit on backward movement of the wave generator frame 123.

The system is supported by encasement 138, which (at least in some embodiments) comprises concrete. In some embodiments, the encasement 138 includes support walls for the wave generator guide rails 122A and 122B. The encasement 138 may provide support for any other suitable components of the system 100. The system 100 is placed within a body of water. The water may include front water 104 located in front of the wave generator 102 and back water 106 located behind the wave generator 102. In various embodiments, wave generator 102 is not sealed and thus front water 104 and back water 106 may mix with each other when the wave generator 102 is at rest.

In the embodiment depicted, wave generator 102 is a wave board, although this disclosure contemplates any suitable wave generator operable to move forwards and backwards to generate surfable or other useful waves. For example, any suitable piston wave generator or flap wave generator may be used in various embodiments. In the embodiment depicted, wave generator 102 is a rigid sheet (e.g., made of metal, rigid plastic, or other suitable material) with a generally smooth rectangular front surface, cross section, and back surface, although in other embodiments, wave generator 102 may have any suitable shape.

The movement of wave generator 102 operates on the front water 104 to generate a surfable or other useful wave. In some embodiments, surfable waves are between 2 and 8 feet high. Surfable waves may, e.g., have a period of 3-5 seconds.

Displacer 108 is depicted as a block with its outer contours forming a rectangular bottom surface and the same rectangular top surface. The displacer 108 may have an equal horizontal cross section along its entire height or at least a portion of its height. During a stroke cycle, the displacer may move up out of the back water 106 and down into back water 106. The displacer may be entirely or partially submerged into the back water 106 and entirely or partially removed from the back water 106 during the stroke cycle.

In the embodiment depicted, the rectangular faces and corresponding cross section of the displacer includes a notch (shown on the left side of the displacer 108 in FIG. 1) so as to allow the movement of drive arm 120 and/or displacer link 121 within the void left by the notch. In other embodiments, the notch may be omitted if the movement pattern of one or more drive arms 120 and displacer links 121 do not intersect with the displacer 108.

In a particular embodiment, the area of the rectangular bottom face (and corresponding cross section) is substantially equal (e.g., within 10%) to the area of the back face of the wave generator 102. In various embodiments, if the surfaces areas are different, the movement speed of the displacer 108 may be configured relative to the movement speed of the wave generator 102 such that the volume of water displaced per unit of time by the displacer 108 is adequate to maintain a constant water level in the back water. For example, if the surface area of the wave generator 102 is twice as large as the surface area of the displacer 108, the displacer may be configured to move down into the water at a rate that is twice as fast as the forward movement of the wave generator 102.

Although a particular shape is shown for displacer 108, this disclosure contemplates any suitable shape for the displacer 108. For example, the displacer 108 may have a circular, oval, triangular, polygonal, or other suitable cross section. In various embodiments, the area of the cross section is constant along the height of the displacer 108 though in some embodiments the area of the cross section could vary (e.g., to compensate for non-linearity that results in the motion of the displacer 108 not matching the motion of the wave generator 102). For example, the displacer may have a larger surface area at the bottom of the displacer than at the top or vice versa, although having a uniform cross section may simplify the design.

The displacer 108 may provide a force that helps counterbalance the inertia force required to move the wave generator 102 back and forth to move water to generate waves. The displacer may essentially act as a spring to provide force to assist movement of the wave generator 102. When the displacer 108 is underwater, the buoyancy of the displacer may provide an upward force and when the displacer 108 is above the water, the mass of the displacer may provide a downward force due to gravity.

In various embodiments, the displacer 108 may include a ballast tank (e.g., a galvanized steel tank) that is adapted to hold water or other substance. In one embodiment, the ballast tank may be leaky such that submersion of the ballast tank within back water 106 may allow water to enter the ballast tank and removal of the ballast tank from the back water 106 may allow for water to drain slowly from the ballast tank. For example, the bottom, sides, or corners of the ballast tank of the displacer 108 may include apertures through which water may flow. This may facilitate easier service of the displacer 108 as the water does not need to be pumped from the ballast tank before the displacer is removed from the system 100, e.g., for maintenance. In various embodiments, the leakage from the ballast tank is slow enough so as not to significantly change the water mass in the ballast tank when the ballast tank is above water during a stroke cycle. In some embodiments, the apertures may be selectively opened and closed. In one embodiment, the ballast tank is placed at the bottom of displacer 108.

In some embodiments, displacer 108 may include a mass of foam (or other material lighter than water) such as a foam block to increase the buoyancy of the displacer 108. In one embodiment, the foam mass is placed above the ballast tank.

In various embodiments, the buoyancy of the displacer 108 may be adjustable. For example, the level of water within the ballast tank at the bottom of the displacer 108 may be adjustable. As another example, the displacer 108 may include one or more trim tanks (e.g., 132A-D) that may be filled with water or other material to a desired level to adjust the buoyancy of the displacer 108. In some embodiments, the trim tanks may be tubes within the displacer 108. For example, as depicted, the tubes may extend from the top of the displacer 108 down into the body of the displacer (e.g., near the bottom of the displacer). In various embodiments, the water or other material within a trim tank 132 is isolated from the water within the ballast tank of the displacer 108 and the trim tanks 132 are not leaky. In other embodiments, the buoyancy may be adjusted by changing the amount of ballast (e.g., water, other liquid, or other material) within the ballast tank of the displacer 108. For example, additional foam may be placed within the ballast tank.

The configurable ballast of the displacer 108 may offer a tradeoff that can be advantageously tuned in various embodiments. Adjustment of the buoyancy may change the force needed by the drive system (e.g., actuator 114) at various positions within the stroke cycle. When the mass is decreased (e.g., by increasing the amount of foam or air in the displacer 108), the displacer 108 may be more buoyant, which may provide more force to help the drive system on the back/up stroke when the displacer 108 starts at its deepest point of submersion and begins to move upward as the wave generator 102 begins moving backward. Conversely, if the mass is increased and the buoyancy is decreased, the displacer 108 may provide an increased gravity force on the forward/down stroke due to the increase in potential energy when the displacer 108 is at its highest point and begins to fall as the waveboard begins its forward motion. Thus, the mass and buoyancy may be configured based on characteristics of the drive system. For example, the ballast may be biased so as to increase the mass of the displacer 108 to reduce the force required of the drive system at the beginning of the stroke cycle when the wave generator 102 is pushed forward and the displacer 108 drops, at the cost of increasing the force required at the end of the stroke cycle. Conversely, the ballast may be biased so as to increase the buoyancy of the displacer 108 to reduce the force required of the drive system at the end of the stroke cycle when the wave generator 102 is pushed backward and the displacer 108 rises, at the cost of increasing the force required at the beginning of the stroke cycle. Because an actuator 114 may be capable of providing adequate force at the beginning of the stroke cycle (when the accumulators are relatively full), such a configuration may reduce the instantaneous power and component size requirements of the actuator 114, thus reducing the cost of the system 100.

Although in the depicted embodiment the displacer 108 is shown as having a straight up and straight down motion, in other embodiments, the displacer may have any suitable motion to displace the back water 106. For example, the displacer 108 may be a flap that rotates about a hinge point into and out of the back water. As another example, the displacer 108 could move simultaneously horizontally and vertically into the water in a manner similar to a plunger wave maker.

In various embodiments, any suitable drive system may be used to cause movement of the wave generator 102 and the displacer 108. In the embodiment depicted, a hydraulic actuator 114 is used as the drive system. The hydraulic actuator 114 may include a hollow cylindrical tube which may encompass a piston 115 which may slide along the tube. One end of the piston 115 is coupled to a torque arm 116. Extension and retraction of the piston 115 may cause rotation of the torque arm 116 which in turn may cause movement of other components of the system, including wave generator 102 and displacer 108.

The actuator 114 may be coupled to a plurality of accumulators 136 (any suitable number of accumulators 136 may be used) via a valve system 134. The accumulators 136 store hydraulic fluid used by the hydraulic actuator. Such a drive system may be advantageous over other drive systems (e.g., a servo motor) by utilizing the accumulators 136 to store energy when energy demands are low and to transmit energy back into the actuator 114 when power demands increase.

In other embodiments, any suitable drive system may be used to drive the movement of the wave generator and displacer 108. For example, the drive system may comprise one or more of a motor, a spring, a rack and pinion, a belt, or other suitable mechanism to create or transfer force to drive the wave generator and displacer 108.

Although in the embodiment depicted a single drive system is used to drive both the wave generator 102 and the displacer 108, in other embodiments a first drive system may be used to drive the movement of the wave generator 102 and a second drive system may be used to drive the movement of the displacer 108.

Power from the drive system may be transferred to the wave generator 102 and displacer 108 using any suitable components. In the embodiment depicted, the linear extension and retraction of the piston 115 results in rotation of the torque arm 116. The torque arm 116 is coupled to torque tube 110 which then rotates about axle 112. The torque tube 110 is coupled to or integrated with drive arm 120 which rotates with torque tube 110. In the embodiment depicted, the drive arm 120 includes a first corner coupled to one end of the wave generator link 118 and a second corner coupled to the displacer link 121. Links 118 and 121 may be rods or other suitable links. The motion of the drive arm 120 causes linear movement of the wave generator link 118 and displacer link 121 to cause movement of wave generator 102 and displacer 108 respectively.

The movement of the wave generator 102 may be facilitated by a wave generator frame 123. The wave generator frame 123 includes wave generator 102, wave generator guide rail interfaces 124A and 124B, and lateral structural channel 140. The components of the wave generator frame 123 move forward and backward together. The wave generator guide rail interfaces 124A and 124B interface with wave generator guide rails 122A and 122B to constrain the movement of the wave generator 102 within a desired pattern. In the embodiment depicted, wave generator frame 123 also includes a lateral structural channel 140 which provides support for the frame 123 and helps maintain a consistent distance between the guide rail interfaces 124A and 124B and keeps the interfaces parallel to each other. In one embodiment, the channel 140 may include or be coupled to a truss 142. The truss may be coupled between interfaces 124. In some embodiments, the truss is also coupled to the wave generator 102. In various embodiments, the frame 123 may include more than one lateral structural channel 140 at any suitable location(s) along the frame (e.g., one channel 140 may be placed proximate one end of the frame and another channel 140 may be placed proximate the other end of the frame). In some embodiments, a lateral structural channel 140 is placed directly over and is coupled to or integrated with waveboard 102. Over travel stops 126A and 126B (or other travel stops) may enforce a limit on forward and/or backward movement of the wave generator frame 123.

In some embodiments, each wave generator guide rail 122 may include one or more wheel bearings that interface with the corresponding wave generator guide rail interface 124 to keep the wave generator 102 oriented in a vertical direction (as opposed to flapping) as it is moved forward or backward. Additionally or alternatively, each wave generator guide rail interface 124 or lateral structural channel 140 may include one or more wheel bearings that interface with the corresponding wave generator guide rail 122. In one embodiment, at least one wheel bearing is disposed on the top of a guide rail 122 and another at least one wheel bearing is disposed on the bottom of the guide rail 122. In other embodiments, any suitable bearings (e.g., sliding bearings) may be used in place of the wheel bearings.

In the embodiment depicted, system 100 also includes displacer guide rails 128A and 128B to guide the up and down motion of the displacer 108. The displacer 108 includes displacer guide rail interfaces 130A and 130B which interface with displacer guide rails 128A and 128B to prevent lateral movement of the displacer 108.

In various embodiments, any suitable combination of travel stops may be used within system 100. For example, stops may be placed on the displacer 108 or the displacer guide rails 122 to arrest the motion of the displacer 108. Stops could also be used in the system to arrest the motion of the displacer of the torque tube 110 at the end of its rotation cycle.

Figure 3:
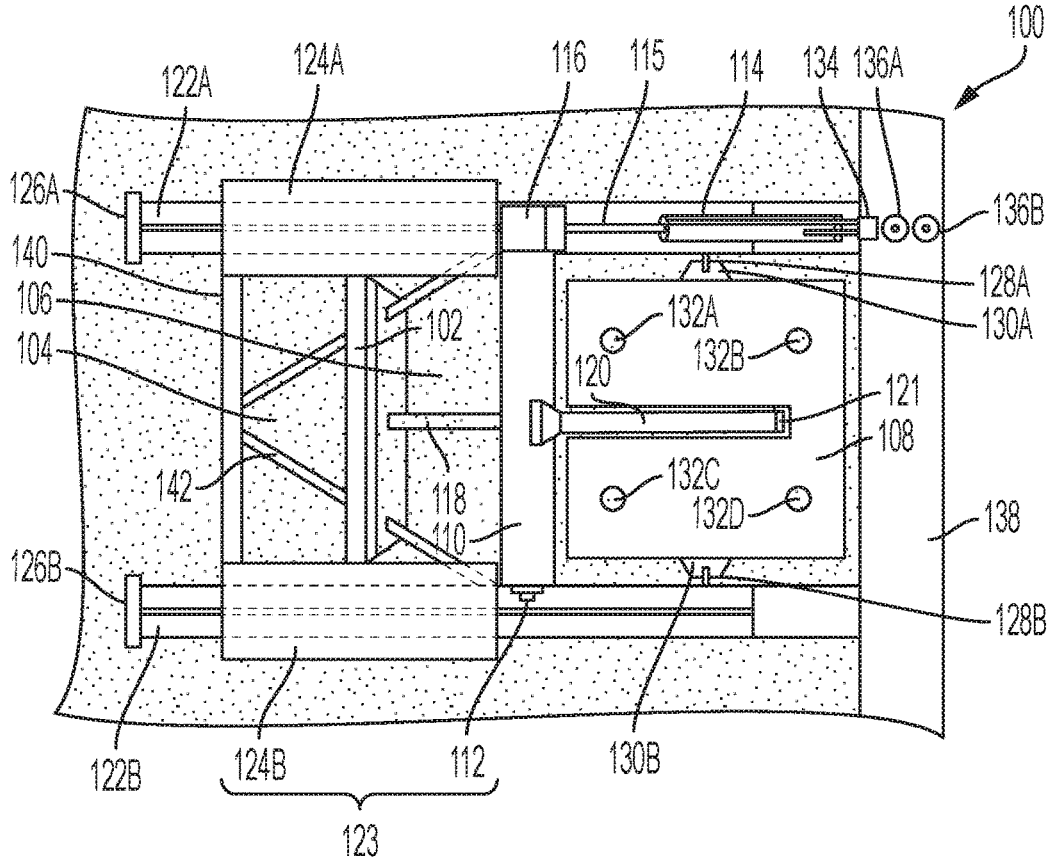
FIG. 3 illustrates a top view of the wave generation system at the rear of the stroke cycle in accordance with certain embodiments.
Figure 4:
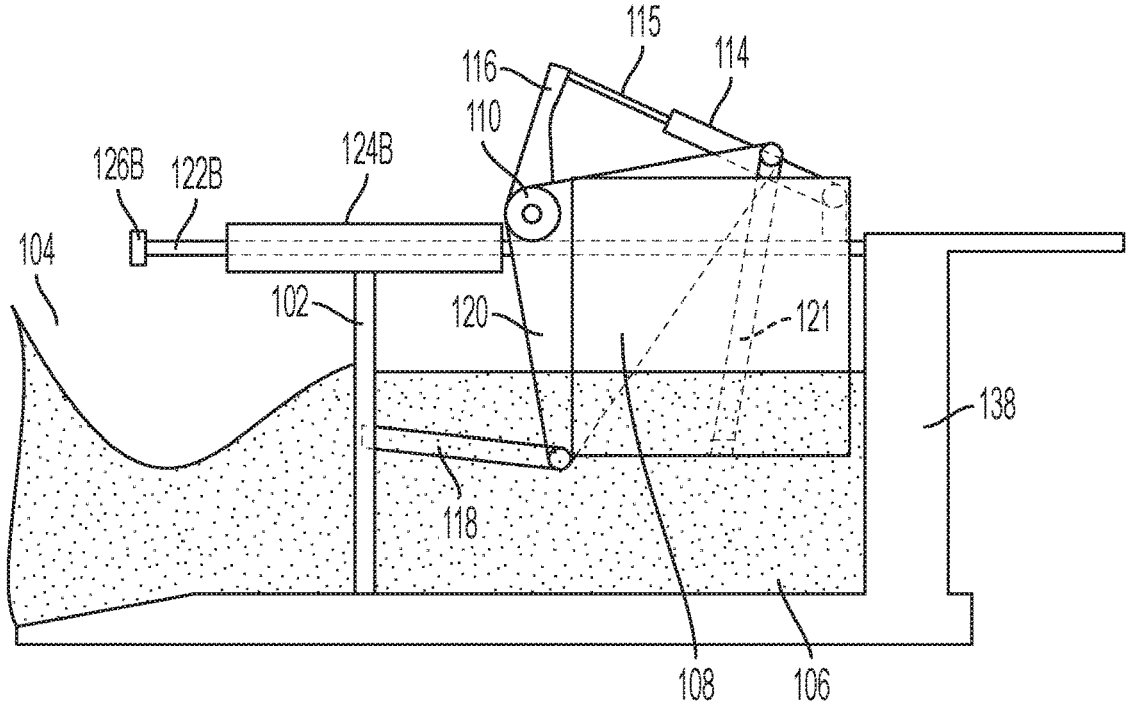
FIG. 4 illustrates a side view of the wave generation system at the rear of a stroke cycle in accordance with certain embodiments.

FIG. 3 illustrates a top view of the wave generation system 100 at the top of the stroke cycle in accordance with certain embodiments. FIG. 4 illustrates a side view of the wave generation system 100 at the top of the stroke cycle in accordance with certain embodiments. As described above, FIGS. 1 and 2 illustrate the wave generation system 100 in the middle of the stroke cycle. As illustrated in FIGS. 3 and 4, the displacer 108 is raised to its highest position and the wave generator 102 is pulled in (in the backward direction) to its furthest position. In order to cause this movement, the piston 115 of the hydraulic actuator 114 has been extended relative to the extension of the piston 115 at the middle of the stroke as illustrated in FIGS. 1 and 2.

Figure 5:
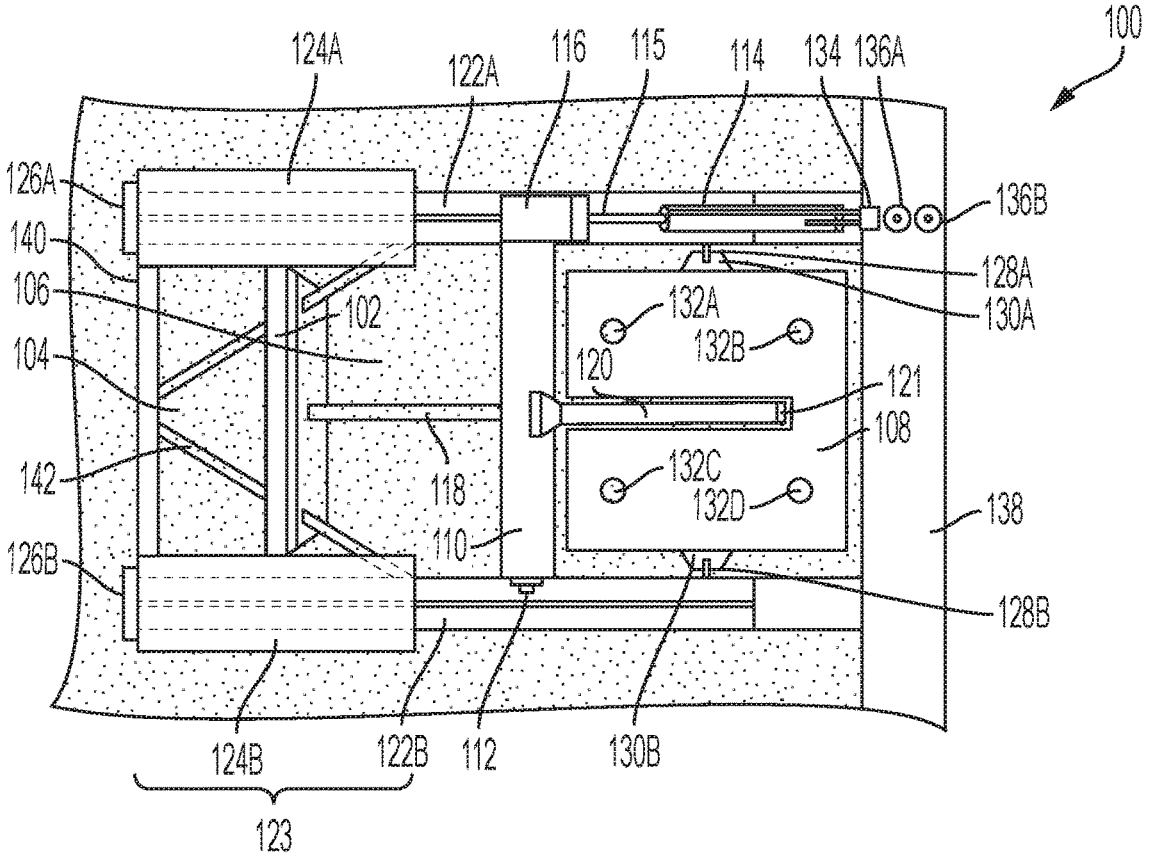
FIG. 5 illustrates a top view of the wave generation system at the front of the stroke cycle in accordance with certain embodiments.
Figure 6:
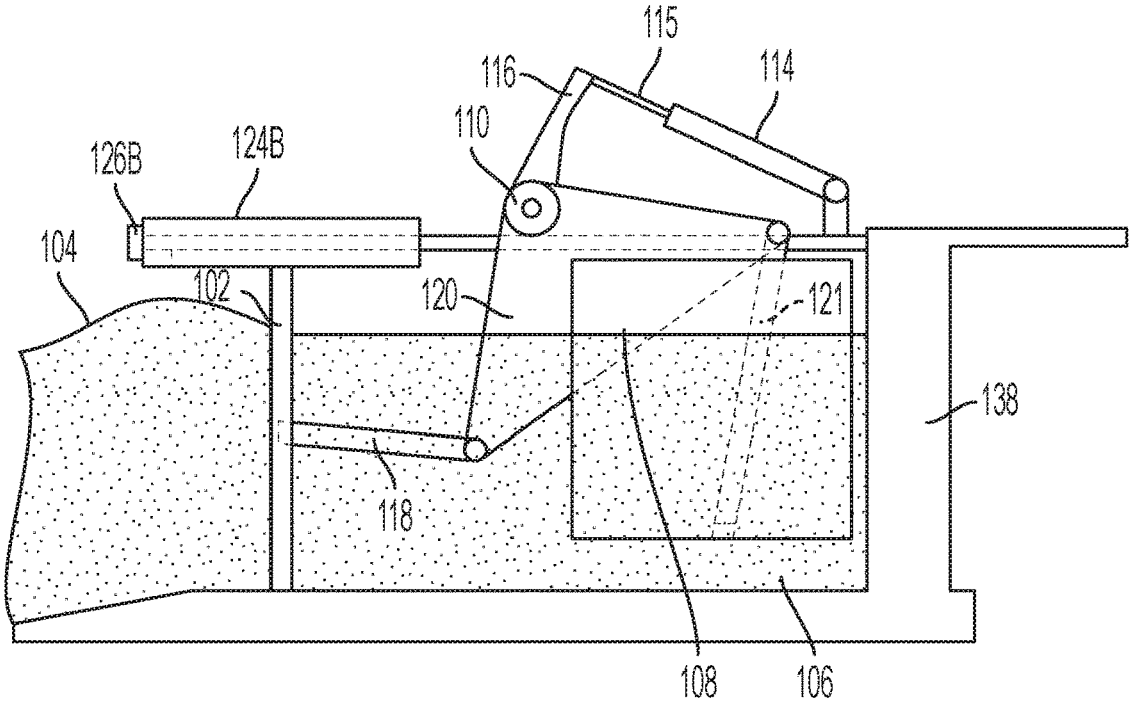
FIG. 6 illustrates a side view of the wave generation system at the front of a stroke cycle in accordance with certain embodiments.

FIG. 5 illustrates a top view of the wave generation system 100 at the bottom of the stroke cycle in accordance with certain embodiments. FIG. 6 illustrates a side view of the wave generation system 100 at the bottom of the stroke cycle in accordance with certain embodiments. As illustrated in FIGS. 5 and 6, the displacer 108 is lowered to its lowest position and the wave generator 102 is pushed out (in the forward direction) to its furthest position. In order to cause this movement, the piston 115 of the hydraulic actuator 114 has been retracted relative to the extension of the piston 115 at the middle of the stroke as illustrated in FIGS. 1 and 2.

Figure 7:
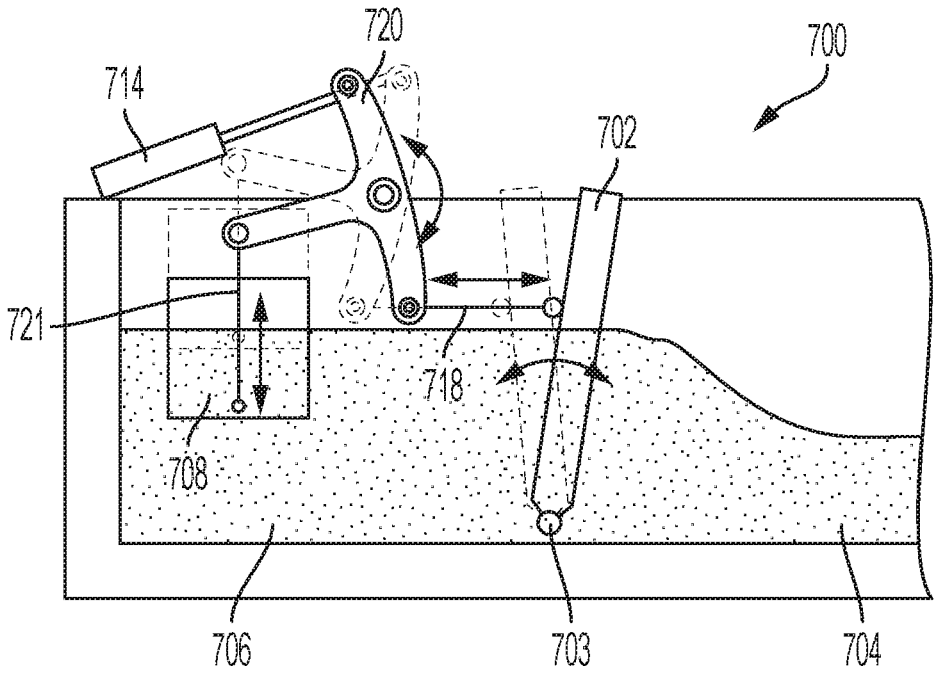
FIG. 7 illustrates a side view of a wave generation system 700 in accordance with certain embodiments.

FIG. 7 illustrates a side view of a wave generation system 700 in accordance with certain embodiments. In this embodiment, system 700 includes a wave generator 702. Wave generator 702 is a flap generator which flaps forward and backward about a hinge point 703 (the solid lines show wave generator 702 in its forward position while the dotted lines show the generator 702 in its backward position). Wave generator 702 is coupled to a drive arm 720 via wave generator link 718. Drive arm 720 is also coupled to displacer 708 via displacer link 721. The drive arm 720 is coupled to hydraulic actuator 714. The actuator 714 is able to cause the wave generator 702 to move back and forth to generate waves in the front water 704 and to cause synchronized movement of the displacer 721 upward and downward to displace water to maintain back water 706 at a relatively constant elevation level throughout the stroke cycle.

Figure 8:
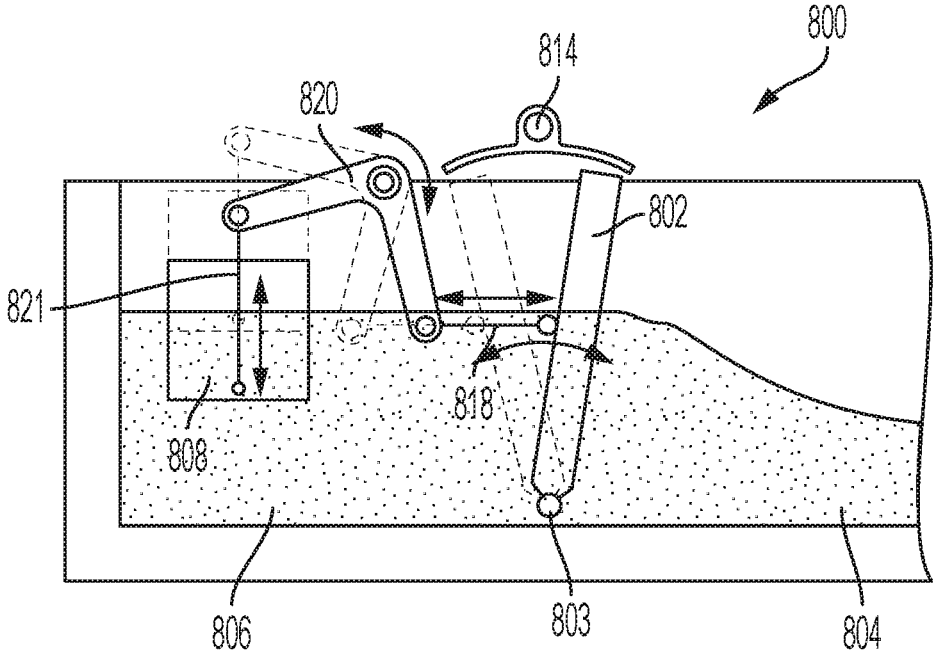
FIG. 8 illustrates a side view of a wave generation system 800 in accordance with certain embodiments.

FIG. 8 illustrates a side view of a wave generation system 800 in accordance with certain embodiments. In this embodiment, system 800 includes a wave generator 802. Wave generator 802 is also a flap generator which flaps forward and backward about a hinge point 803 (the solid lines show wave generator 802 in its forward position while the dotted lines show the generator 802 in its backward position). Wave generator 802 is coupled to a drive arm 820 via wave generator link 818. Drive arm 820 is also coupled to displacer 808 via displacer link 821. In this embodiment, a motor 814 in combination with a belt or a rack and pinion may be coupled to the wave generator 802 to drive the wave generator forward and backward. This motion may cause the drive arm 820 to move (via link 818), thus also controlling movement of the displacer 808. The upward and downward movement of the displacer 821 which is synchronized with the backward and forward movement of the wave generator 802 displaces water to maintain back water 806 at a relatively constant elevation level throughout the stroke cycle.

Figure 9:
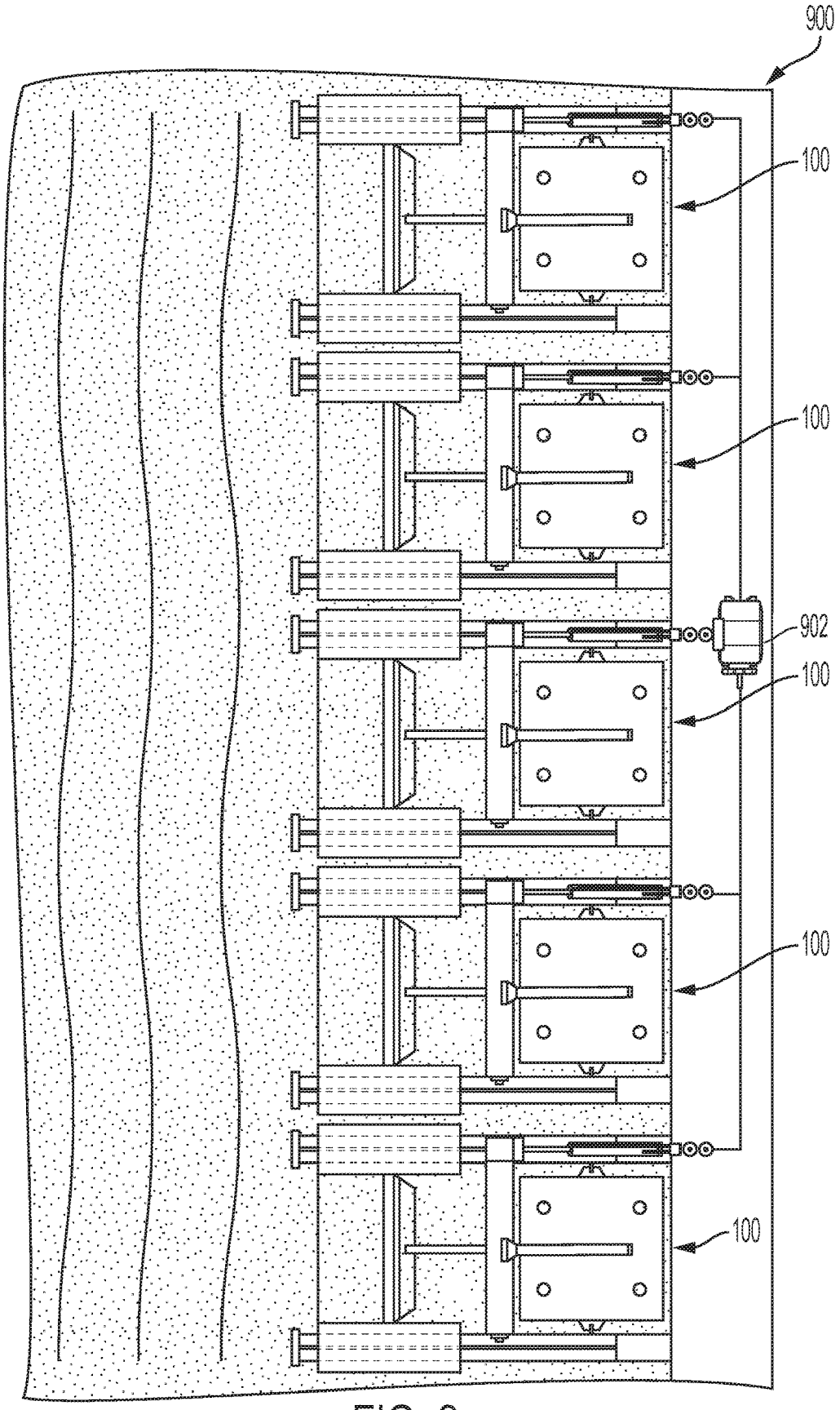
FIG. 9 illustrates a top view of a wave generation system 900 in accordance with certain embodiments.

FIG. 9 illustrates a top view of a wave generation system array 900 in accordance with certain embodiments. The wave generation system array 900 includes a plurality of wave generation systems 100 placed together in series. In other embodiments, a system array may comprise a plurality of other wave generations systems, such as systems 700, systems 800, or other suitable wave generation systems. Wave generation systems 100 may be separated from each other via partitions (e.g., support walls of encasement 138). The surface areas and/or heights of the back waters 106 of the various systems 100 may vary from system to system.

The wave generation systems 100 may operate together to form contiguous or single waves that are ideal for surfing. In some embodiments, a common component may be utilized by multiple individual wave generation systems 100 of the array. For example, torque tubes 110 of multiple individual wave generation systems 100 may rotate about a single axle 112 that spans multiple wave generation systems 100. As another example, a pump 902 of the system array 900 may provide hydraulic fluid to multiple actuators 114.

In various embodiments, a wave or multiple waves are generated by starting with the wave generators in the forward position, bringing them back, and then pushing them forward again. This may result in a trough/peak for maximum surf height on a single wave. Continuous backward and forward motion of the wave generator may create a continuous series of waves. The wave crest typically occurs at maximum forward velocity of the wave generator, which may occur at the mid-stroke position. The wave trough typically occurs at maximum rearward velocity of the wave generator, which again generally occurs at the mid-stroke position. In this disclosure, particular embodiments of the subject matter have been described. Other embodiments are within the scope of the following claims. In some cases, the features, components, and actions recited in the claims can be arranged or performed in a different manner and still achieve desirable results. In addition, the processes depicted in the accompanying figures do not necessarily require the particular order shown, or sequential order, to achieve desirable results.

A detailed description has been given with reference to specific exemplary embodiments. It will, however, be evident that various modifications and changes may be made thereto without departing from the broader spirit and scope of the invention as set forth in the appended claims. The specification and drawings are, accordingly, to be regarded in an illustrative sense rather than a restrictive sense. Furthermore, the foregoing use of embodiment and other exemplarily language does not necessarily refer to the same embodiment or the same example, but may refer to different and distinct embodiments, as well as potentially the same embodiment.

The invention claimed is:

1. An apparatus comprising:

a wave generator configured to move water on a front side of the wave generator to generate a surfable wave; and a displacer configured to move in synchronization with the wave generator, the displacer to displace water on a back side of the wave generator to compensate for water elevation changes on the back side of the wave generator that would occur in the absence of the displacer, wherein the wave generator is configured to move forward as the displacer moves downward during a stroke cycle and the wave generator is configured to move backward as the displacer moves upward during the stroke cycle.

2. The apparatus of claim 1, wherein the displacer is configured to displace a varying amount of the water on the back side over a stroke cycle of the apparatus in order to maintain a substantially constant height of the water on the back side of the wave generator throughout the stroke cycle.

3. The apparatus of claim 1, wherein the apparatus comprises a drive arm coupled to the wave generator via a first link and to the displacer via a second link.

4. The apparatus of claim 1, wherein the displacer is coupled to the wave generator via at least one rotatable component, wherein the at least one rotatable component causes the displacer to move in synchronization with the wave generator.

5. The apparatus of claim 4, further comprising a drive system comprising a hydraulic actuator, the hydraulic actuator comprising a piston to extend and retract to cause the at least one rotatable component to rotate and move the wave generator and the displacer.

6. The apparatus of claim 4, wherein the at least one rotatable component comprises a drive arm coupled to the wave generator via a first link and to the displacer via a second link.

7. The apparatus of claim 1, wherein the wave generator comprises a wave board to move horizontally through the water on the front side of the wave generator.

8. The apparatus of claim 1, wherein the wave generator comprises a flap rotatable around a hinge point.

9. The apparatus of claim 1, wherein the displacer has a block shape with a horizontal rectangular cross section.

10. The apparatus of claim 1, wherein a surface area of a bottom side of the displacer is substantially equal to a surface area of a front side of the wave generator.

11. The apparatus of claim 10, wherein the displacer comprises a notched recess to allow for movement of a link coupled to the displacer.

12. The apparatus of claim 1, wherein the displacer comprises a ballast tank.

13. The apparatus of claim 12, wherein the ballast tank is a leaky tank comprising at least one aperture such that when the ballast tank is placed under water the ballast tank will fill up and when the ballast tank is removed from the water the ballast tank will drain.

14. The apparatus of claim 12, wherein the displacer comprises a buoyant block above the ballast tank.

15. The apparatus of claim 12, wherein the displacer further comprises at least one trim tank allowing for adjustment of a mass of the displacer.

16. The apparatus of claim 1, wherein the apparatus further includes a plurality of vertically oriented guide rails to constrain a motion of the displacer to a vertical direction and a plurality of horizontally oriented guide rails to constrain a motion of the wave generator to a horizontal direction.

17. The apparatus of claim 1, further comprising an encasement comprising support walls, wherein the water on the back side of the wave generator is bounded by a back surface of the wave generator and the support walls of the encasement.

18. The apparatus of claim 1, further comprising an actuator coupled to the displacer via a displacer link, the actuator further coupled to the wave generator via a wave generator link.

19. A system comprising:

a plurality of wave generation systems disposed in series to produce at least one surfable wave, a respective wave generation system comprising:

a wave generator configured to move water on a front side of the wave generator; and a displacer configured to move in synchronization with the wave generator, the displacer to displace water on a back side of the wave generator to compensate for water elevation changes on the back side of the wave generator that would occur in the absence of the displacer, wherein the wave generator is configured to move forward as the displacer moves downward during a stroke cycle and the wave generator is configured to move backward as the displacer moves upward during the stroke cycle.

* * * * *